US006567624B1

(12) United States Patent
Murata

(10) Patent No.: US 6,567,624 B1
(45) Date of Patent: May 20, 2003

(54) FIXING APPARATUS AND IMAGE FORMING APPARATUS

(75) Inventor: Hiroshi Murata, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,762

(22) Filed: Oct. 31, 2001

(51) Int. Cl.[7] ..... G03G 15/20

(52) U.S. Cl. ..... 399/69; 219/216

(58) Field of Search ..... 399/69, 67, 320, 399/328; 219/216, 490, 494

(56) References Cited

U.S. PATENT DOCUMENTS 5,905,925 A * 5/1999 Kawabata et al. ..... 399/67 X
6,185,388 B1 * 2/2001 Yamamoto ..... 219/216
6,381,422 B1 * 4/2002 Tanaka ..... 399/69 X

FOREIGN PATENT DOCUMENTS

| | | | |
|---|---|---|---|
| JP | 09-179438 | * | 7/1997 |
| JP | 11-073056 | | 3/1999 |
| JP | 2000-122461 | | 4/2000 |

* cited by examiner

*Primary Examiner*—Sophia S Chen
(74) *Attorney, Agent, or Firm*—Foley & Lardner

(57) ABSTRACT

A fixing apparatus includes a fixing device having a heating roller which rotates and a press roller which rotates in tight contact with the heating roller, and adopted to heat and press a medium with an unfixed image by passing the medium between the rollers, thereby fixing the unfixed image, a detection device which detects temperatures of the heating and press rollers, and a control device which variably controls rotating states of the heating and press rollers based on the temperatures detected by the detection device.

3 Claims, 6 Drawing Sheets

FIXING APPARATUS AND IMAGE FORMING APPARATUS

BACKGROUND OF THE INVENTION

The present invention relates to a fixing apparatus and image forming apparatus in, e.g., a color electronic copying machine, printer, or facsimile machine, for fixing an unfixed toner image on a recording medium by fusing.

Some color electronic copying machine has a photosensitive belt for carrying a latent image. A plurality of developing units for selectively supplying toners of respective colors (Y, M, C, and K) are disposed to oppose the photosensitive belt. In this color electronic copying machine, toner images of respective colors formed on the photosensitive belt are transferred onto, e.g., an intermediate transfer body, in an overlaying manner to form a color image. The color image is then transferred at once onto a recording sheet. The recording sheet transferred with the color image is fed to a fixing device. The fixing device fixes the color image on the recording sheet.

The fixing device has a fixing roller serving as a heating roller incorporating a heating source, and a press roller to be urged by the fixing roller. When the recording sheet transferred with the color image passes between the fixing roller and press roller, it is heated and pressed, so the color image is fixed.

In a fixing device of this type, in order to shorten the warm-up time, the heating source such as a heater lamp is arranged only in the fixing roller with which the toner image comes into contact. The press roller does not have a heating source in it. Hence, the press roller need to efficiently receive heat from the fixing roller with the heating source.

The recording sheet passes between the fixing roller and press roller. When image fixing operation is repeated, heat is not sufficiently conducted to the press roller. Then, the surface temperature of the press roller decreases gradually, and defective fixing occurs.

Particularly, in fixing an image such as a color image with a large toner attaching amount, the temperature of the press roller largely influences the fixing properties. If the temperature of the press roller is low, defective fixing tends to occur.

Assume that after copy operation is started, the image of a recording sheet which is fed first between the fixing roller and press roller is to be fixed. In this case, sometimes the press roller does not reach a temperature sufficiently high for fixing. Then, defective fixing occurs.

BRIEF SUMMARY OF THE INVENTION

The present invention has been made in view of the above situations, and has as its object to provide a fixing apparatus and image forming apparatus which can fix an image after the press roller is heated to a sufficiently high temperature.

A fixing apparatus according to the present invention comprises a fixing device, having a heating roller which rotates and a press roller which rotates in tight contact with the heating roller, and adopted to heat and press a medium with an unfixed image by passing the medium between the rollers, thereby fixing the unfixed image, a detection device which detects temperatures of the heating and press rollers, and a control device which variably controls rotating states of the heating and press rollers based on the temperatures detected by the detection device.

A image forming apparatus according to the present invention comprises a rotatable image carrier which carries an electrostatic latent image, an image forming device which forms the electrostatic latent image on the image carrier, a developing device which supplies a developer to the electrostatic latent image, formed by the image forming device, by rotation of a developing roller, thereby forming a developer image, a transfer device which transfers the developer image developed by the developing device onto a medium, a fixing device, having a heating roller which rotates and a press roller which rotates in tight contact with the heating roller, and adopted to heat and press a medium with an unfixed image by passing the medium between the rollers, thereby fixing the unfixed image, a detection device which detects temperatures of the heating and press rollers, and a control device which variably controls rotating states of the heating and press rollers based on the temperatures detected by the detection device.

An image forming apparatus according to the present invention is an image forming apparatus comprising a rotatable image carrier which carries an electrostatic latent image, an image forming device which forms the electrostatic latent image on the image carrier, a plurality of developing devices which selectively supply developers of different colors to the electrostatic latent image, formed by the image forming device, by rotation of a developing roller, thereby forming developer images of respective colors, a transfer device which transfers the developer images of the respective colors developed by the plurality of developing devices onto a medium in an overlaid manner, a fixing device, having a heating roller which rotates and a press roller which rotates in tight contact with the heating roller, and adopted to heat and press a medium with an unfixed image by passing the medium between the rollers, thereby fixing the unfixed image, a detection device which detects temperatures of the heating and press rollers, and a control device which variably controls rotating states of the heating and press rollers based on the temperatures detected by the detection device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
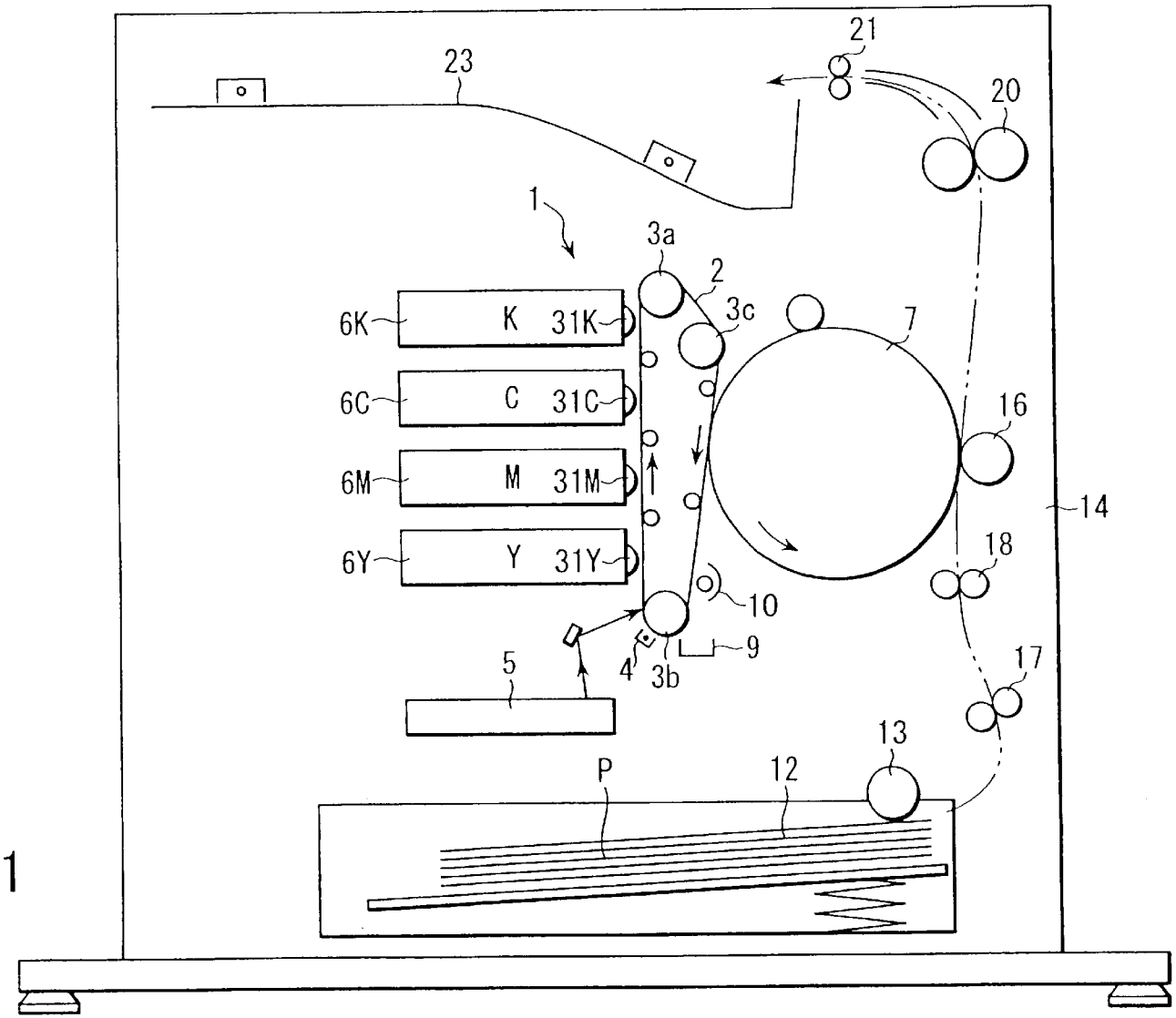
FIG. 1 is a view showing the internal arrangement of a color electrophotographic copying machine according to the first embodiment of the present invention.

FIG. 1 is a view showing the arrangement of a color electrophotographing apparatus as an image forming apparatus according to the first embodiment of the present invention.

This color electrophotographing apparatus has an image forming unit 1. The image forming unit 1 has a flexible photosensitive belt 2 serving as an image carrier. The photosensitive belt 2 is looped between a plurality of first to third rollers 3*a* to 3*c* with a predetermined tension to travel in the direction of arrows.

A charging device 4, laser exposure device 5, and developing devices 6Y to 6K are disposed around the photosensitive belt 2 along its traveling direction. The charging device 4 charges the photosensitive belt 2 at a predetermined potential. The laser exposure device 5 serves as an image forming device for forming an electrostatic latent image on the charged photosensitive belt 2. The developing devices 6Y to 6K, having respective developing rollers 31Y to 31K, visualize the electrostatic latent image formed on the photosensitive belt 2 by supplying yellow (Y), magenta (M), cyan (C), and black (K) toners as developers to it.

Furthermore, an intermediate transfer drum 7, discharge lamp 10, and cleaner device 9 are disposed around the photosensitive belt 2 along its traveling direction. The intermediate transfer drum 7 serves as a rotatable transfer device for temporarily holding the toner image formed on the photosensitive belt 2. The cleaner device 9 removes the toner left on the photosensitive belt 2.

That portion of the photosensitive belt 2 which extends between the first and second rollers 3*a* and 3*b* opposes the developing devices 6Y to 6K through a predetermined gap. That portion of the photosensitive belt 2 which extends between the second and third rollers 3*b* and 3*c* is in tight contact with the outer surface of the intermediate transfer drum 7.

Either one of the first to third rollers 3*a* to 3*c* is connected to a driving motor (not shown). Upon rotation of the driving motor, the first to third rollers 3*a* to 3*c* are rotatably driven in the direction indicated by arrows at a predetermined speed.

A sheet cassette 12 for storing sheets P as media with a predetermined size is provided below the image forming unit 1. The sheet cassette 12 has a feed roller 13 for taking up the sheets P one by one. The sheet P taken up by the feed roller 13 is conveyed upward along a convey path 14 extending in the vertical direction.

A convey roller pair 17, an aligning roller pair 18, a transfer roller 16 serving as a transfer device, a fixing apparatus 20, and a delivery roller pair 21 are sequentially disposed along the convey path 14 in the convey direction of the sheet P.

The convey roller pair 17 clamps and conveys the sheet P. The aligning roller 18 temporarily stops the sheet P conveyed to it, corrects tilt of the sheet P with respect to the convey direction, and causes the leading end of the sheet P to coincide with the leading end of the toner image on the intermediate transfer drum 7. The transfer roller 16 opposes the intermediate transfer drum 7 and transfers the toner image formed on the intermediate transfer drum 7 onto the sheet P. The fixing apparatus 20 fixes the toner image transferred to the sheet P. The delivery roller pair 21 delivers the sheet P. A delivery tray 23 for receiving the sheet to be delivered is provided on the delivery side of the delivery roller pair 21.

Full-color printing operation of the above color electrophotographing apparatus will be described.

First, the surface of the photosensitive belt 2, the rear surface of the photosensitive layer of which is grounded to 0 V, is uniformly charged by the charger 4 to −700 V. Then, the laser exposure device 5 is driven in response to a yellow image signal from a control unit (not shown) to form a yellow latent image on the photosensitive belt 2. The potential of this electrostatic latent image is about −100 V.

Before forming the yellow latent image, the yellow developing unit 6Y is moved toward the photosensitive belt 2. In synchronism with this, a developing roller 31Y is rotated, and a voltage of −300 V is applied to it. Upon movement of the developing unit 6Y, when the developing roller 31Y comes into contact with the photosensitive belt 2, the latent image is developed, and a yellow toner image is formed on the photosensitive belt 2.

The yellow toner image on the photosensitive belt 2 is electrostatically transferred to the intermediate transfer drum 7 to which a voltage of +1 kV is applied, and the toner left on the photosensitive belt 2 is scraped with the blade of the cleaner device 9. The surface charges left on the photosensitive belt 2 are removed by the discharge lamp 10.

The surface of the photosensitive belt 2 is charged again, and a magenta latent image is formed this time, in the same manner as described above. This latent image is developed by the magenta developing unit 6M to form a magenta toner image, which is overlaid on the yellow toner image on the intermediate transfer drum 7. The same cycle is repeated for cyan (C) and black (K) to form, on the intermediate transfer drum 7, a color image in which toner images of four colors are overlaid.

At this time, the sheet P is supplied from the sheet cassette 12 and fed along the convey path 14. The sheet P is sandwiched by the convey roller pair 17, conveyed to the resist roller pair 18, aligned, and fed to a portion between the intermediate transfer drum 7 and transfer roller 16. A voltage of +2 kV to 3 kV is applied to the transfer roller 16. Hence, the toner images of four colors formed on the intermediate transfer drum 7 are transferred to the sheet P at once. After that, the sheet P on which the toner images of four colors are transferred is fed to the heat roll type fixing unit 20. The toner images are fixed by fusion onto the sheet P, to form a color image on the sheet P.

The toner left on the intermediate transfer drum 7 is removed by the cleaner device 9 using a brush to which a voltage of +1.5 kV is applied.

Figure 2:
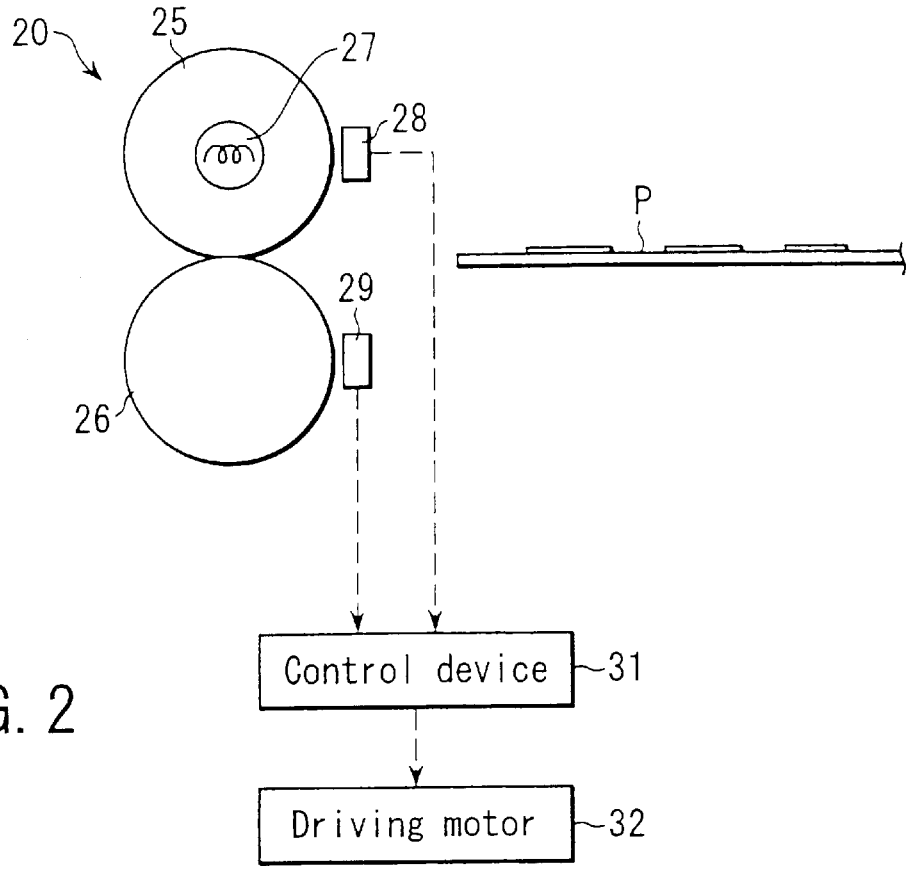
FIG. 2 is a view showing the arrangement of a fixing apparatus.

FIG. 2 is a view showing the arrangement of the fixing apparatus 20.

The fixing apparatus 20 has a fixing roller 25 and press roller 26. The fixing roller 25 serves as a heating roller, and the press roller 26 is brought into tight contact with the lower portion of the fixing roller 25. The fixing roller 25 has a heater lamp 27 serving as a heat source in it.

Temperature sensors 28 and 29 are disposed in the vicinities of the fixing roller 25 and press roller 26. The temperature sensors 28 and 29 serve as a detection device for detecting the surface temperatures of the fixing roller 25 and press roller 26. The temperature sensors 28 and 29 are connected to a control device 31 through a transmission circuit. The control device 31 is connected to a driving motor 32 through a control circuit. The driving motor 32 rotatably drives the fixing roller 25 and press roller 26. The control device 31 variably controls the rotational speed of the fixing roller 25 and press roller 26 through detection temperatures transmitted from the temperature sensors 28 and 29.

The sheet P passes between the fixing roller 25 and press roller 26 with its color image-side surface and its surface opposite to the color image side being in contact with the fixing roller 25 and press roller 26, respectively. Hence, the sheet P is heated and pressed, so the color image is fixed to the sheet P.

Figure 3:
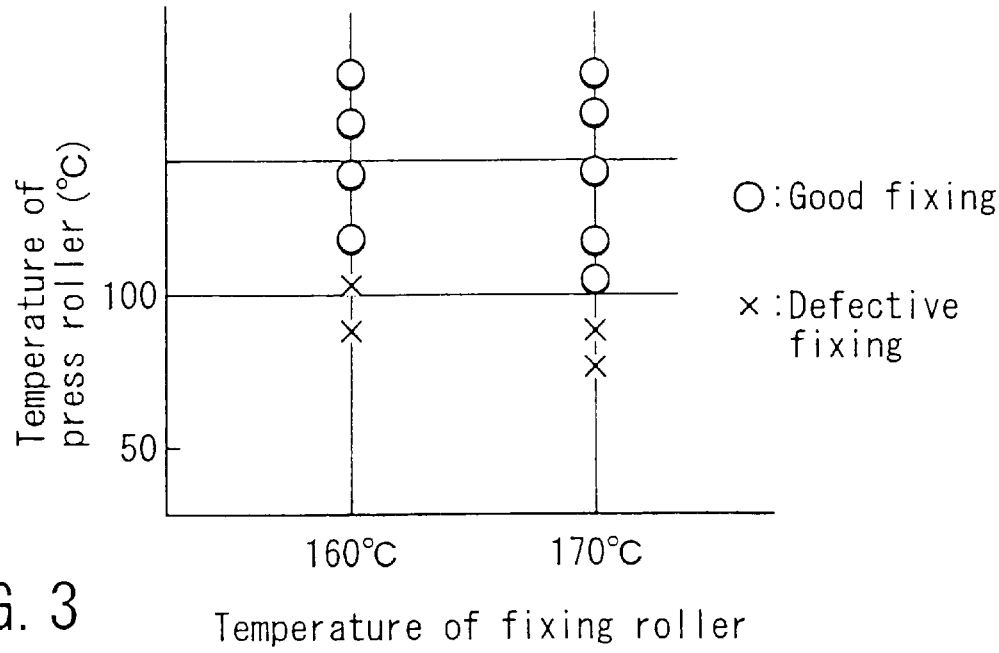
FIG. 3 is a graph showing the quality of image fixing properties depending on the temperature changes of a fixing roller and press roller.

FIG. 3 shows the quality of the image fixing properties depending on the temperature changes of the fixing and press rollers 25 and 26.

Even when the fixing roller 25 had reached a predetermined temperature, if the temperature of the press roller 26 was low, defective fixing such as toner separation occurred.

Figure 4:
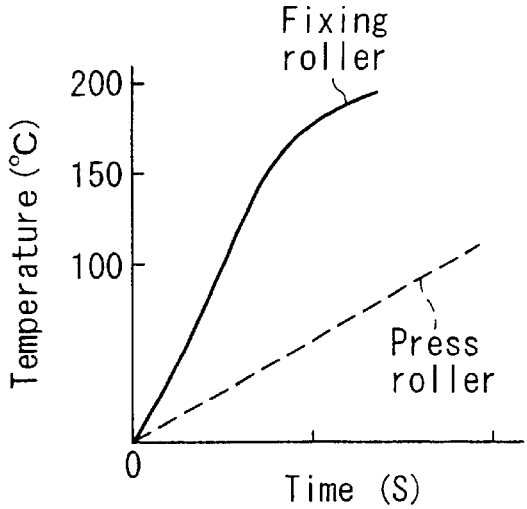
FIG. 4 is a graph showing temperature changes occurring when the fixing and press rollers are rotated at a low speed.
Figure 5:
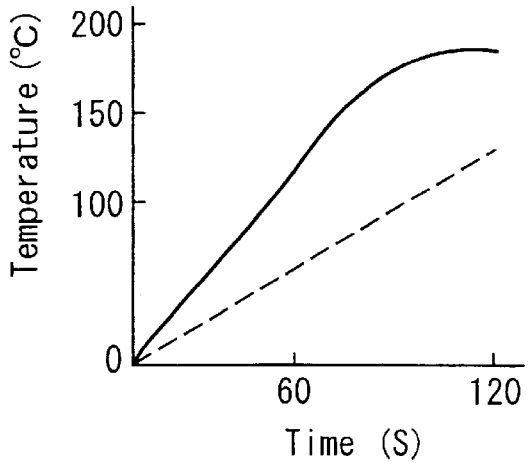
FIG. 5 is a graph showing temperature changes occurring when the fixing and press rollers are rotated at a normal speed.
Figure 6:
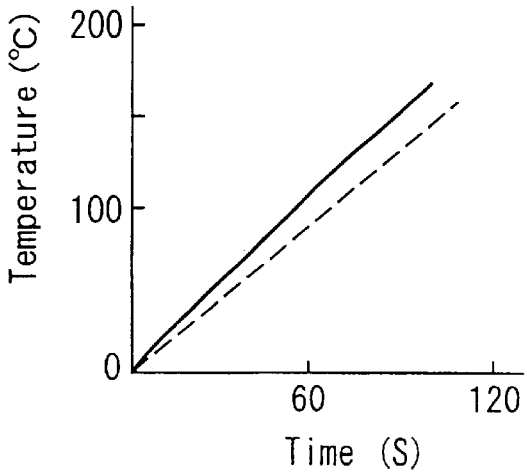
FIG. 6 is a graph showing temperature changes occurring when the fixing and press rollers are rotated at a high speed.

FIGS. 4 to 6 show results obtained by measuring the temperatures of the fixing roller 25 and press roller 26 while changing their rotational speed when the fixing apparatus 20 is to be warmed up from room temperature. More specifically, temperatures were measured in cases wherein the rotational speed of the rollers 25 and 26 was higher and lower, respectively, than the rotational speed of the rollers 25 and 26 determined as the reference in the image forming apparatus. How the temperatures rose was thus examined.

FIG. 4 shows temperature changes occurring when the fixing and press rollers 25 and 26 are rotated at a speed lower than the reference speed. In this case, the temperature of the fixing roller 25 rose faster than when it was rotated at the reference speed, while the temperature of the press roller 26 rose slowly.

FIG. 5 shows temperature changes occurring when the fixing and press rollers 25 and 26 are rotated at the reference speed.

FIG. 6 shows temperature changes occurring when the fixing and press rollers 25 and 26 are rotated at a speed faster than the reference speed. In this case, the temperature of the press roller 26 rose faster than when it was rotated at the reference speed.

A description will be made on cases wherein verification was performed in the actual state by utilizing the results shown in FIGS. 4 to 6.

Figure 7:
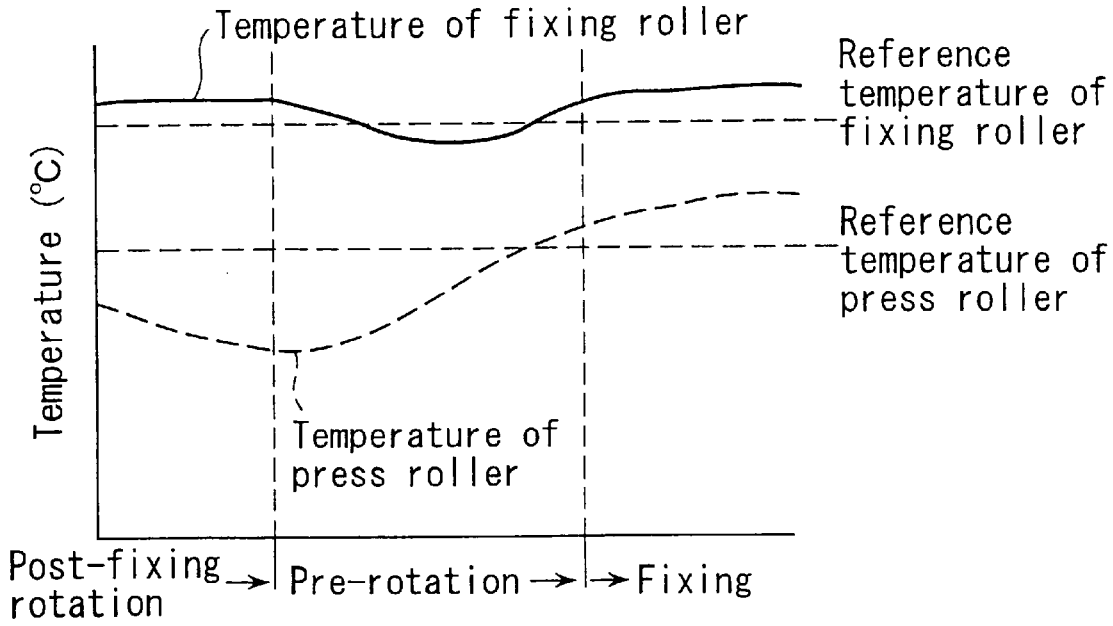
FIG. 7 is a graph showing temperature changes occurring when the fixing and press rollers are rotated at a high speed with the press roller being at a temperature lower than a reference temperature.
Figure 8:
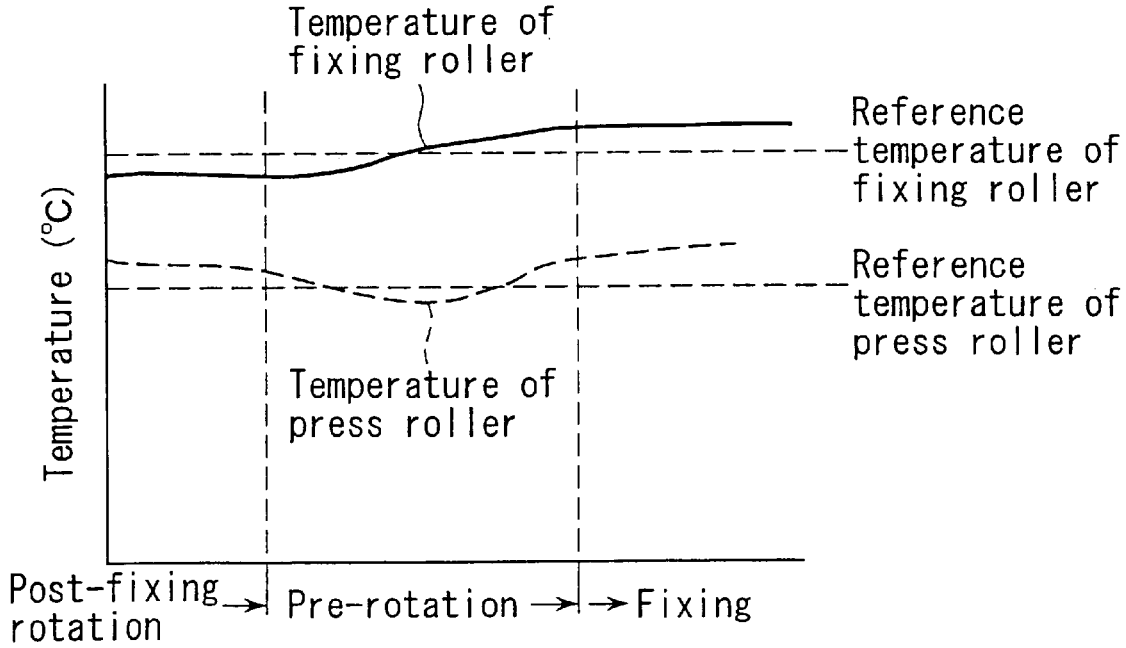
FIG. 8 is a graph showing temperature changes occurring when the fixing and press rollers are rotated at a low speed with the fixing roller being at a temperature lower than the reference temperature.
Figure 9:
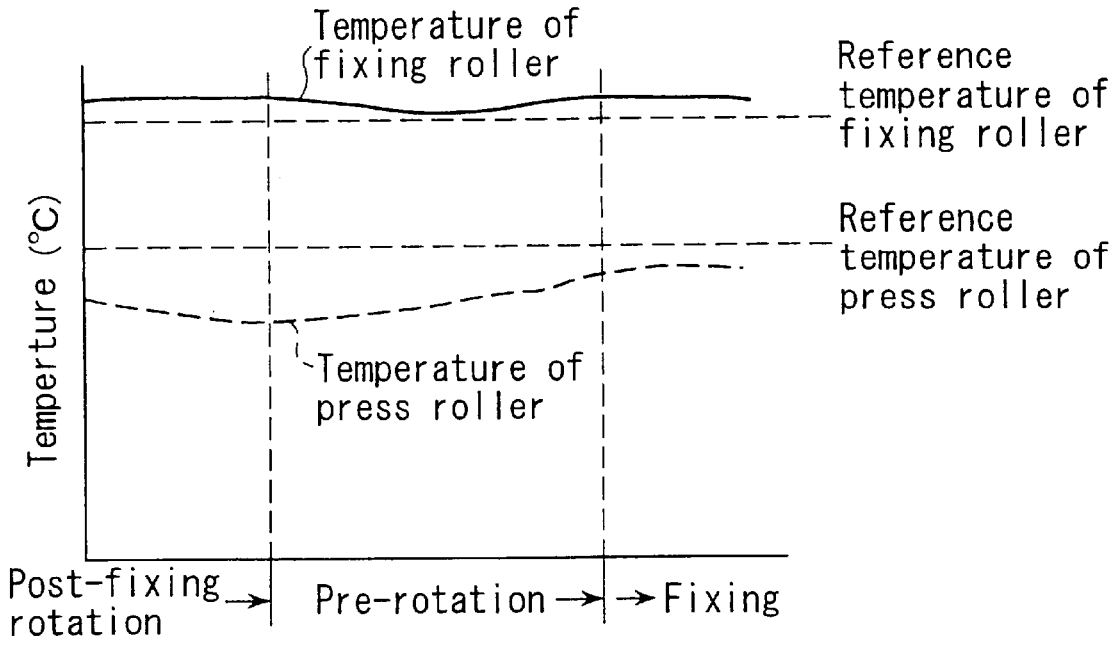
FIG. 9 is a graph showing temperature changes occurring when the fixing and press rollers are rotated at a normal speed with the press roller being at a temperature lower than the reference temperature.

In practice, in continuous image fixing, when the press roller 26 or fixing roller 25 had not reached the reference temperature at which fixing was possible, particularly after the image was fixed, control operations as shown in FIGS. 7 to 9 were performed.

FIG. 7 shows a state wherein, when the fixing roller 25 has reached the predetermined temperature and the temperature of the press roller 26 is low, the rotational speed of the rollers 25 and 26 is increased before the sheet P reaches the fixing apparatus 20. According to FIG. 7, the press roller 26 could be heated to the reference temperature or higher within a predetermined period of time with which the sheet P reaches the fixing apparatus 20. This is probably due to the following reason. As the rollers 25 and 26 were rotated at a high speed, the contact distance between them increased. Accordingly, more heat shifted from the fixing roller 25 with the heater lamp 27 to the press roller 26.

"Post-fixing rotation" described in FIG. 7 and FIGS. 8 to 10 to be described later refers to a state wherein the rollers 25 and 26 rotate immediately after the toner image is fixed to the sheet P. "Pre-rotation" refers to a state wherein a process such as development or transfer takes place. "Fixing" refers to a state wherein the toner image is actually being fixed on the sheet P with the fixing apparatus 20.

FIG. 8 shows a case wherein, when the press roller 26 has reached the predetermined temperature and the temperature of the fixing roller 25 is low, the rotational speed of the rollers 25 and 26 is decreased. According to FIG. 8, the fixing roller 25 could rise to the predetermined temperature within a predetermined period of time. This is probably due to the following reason. As the rollers 25 and 26 were rotated at a low speed, the contact distance between them within a predetermined period of time was shortened. Accordingly, the press roller 26 was less deprived of heat, and the fixing roller 25 itself was heated well, so the temperature rise rate of the fixing roller 25 increased.

As described above, the rotational speed of the rollers 25 and 26 is changed until the sheet P reaches the fixing apparatus 20 in accordance with the states of the fixing roller 25 and press roller 26 with respect to the predetermined temperatures. Thus, the rollers 25 and 26 can be efficiently set to the predetermined temperatures at which fixing is possible.

When the temperatures of both the fixing roller 25 and press roller 26 are lower than the reference temperature, the rollers 25 and 26 are rotated at an ordinary recording rotational speed to increase their temperatures.

The rotational speed of the rollers 25 and 26 must be appropriately selected in accordance with the materials of the rollers 25 and 26, the output from the heat source 27, and the heating method.

FIG. 9 shows a case wherein, when the fixing roller 25 has reached the predetermined temperature and the temperature of the press roller 26 is low, the rollers 25 and 26 are rotated at the ordinary speed without increasing their speed as in FIG. 7.

In this case, the temperature rise of the press roller 26 was slow, and the press roller 26 could not be heated to the reference temperature before the sheet P reached the fixing apparatus 20. Accordingly, defective fixing sometime occurred.

Figure 10:
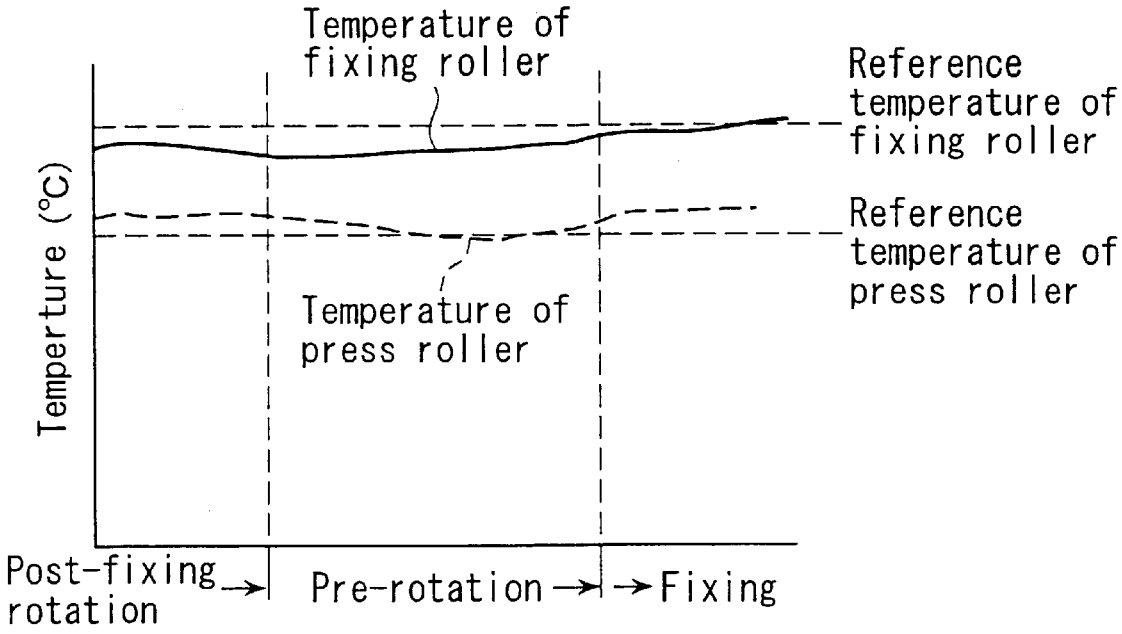
FIG. 10 is a graph showing temperature changes occurring when the fixing and press roller are rotated at the normal speed with the fixing roller being at a temperature lower than the reference temperature.

FIG. 10 shows a case wherein, when the press roller 26 reaches the predetermined temperature and the fixing roller 25 has a low temperature, the fixing roller 25 and press roller 26 are rotated at the ordinary speed without decreasing their speed as in FIG. 8. In this case, the temperature of the fixing roller 25 did not rise in time, and defective fixing sometimes occurred.

The second embodiment of the present invention will be described.

In the first embodiment described above, the rotational speed of the fixing and press rollers 25 and 26 is controlled during ordinary image forming operation. In the second embodiment, the rotational speed of fixing and press rollers 25 and 26 is controlled after a copy start command is received and until a first sheet P reaches a fixing apparatus 20.

For example, assume that the fixing roller 25 maintains a certain predetermined temperature but the press roller 26 cannot rise to a necessary temperature with the ordinary rotational speed. In this case, the rotational speed of the rollers 25 and 26 is increased while steps such as pre-fixing development and transfer are performed, so the press roller 26 reaches the necessary temperature.

Conventionally, fixing is performed while the fixing roller 25 maintains a certain predetermined temperature. Sometimes, when the image of the sheet P which is sent first to the fixing apparatus 20 is fixed, defective fixing occurs.

To examine the cause for this, the temperatures of the fixing roller 25 and press roller 26 were measured. The temperature of the press roller 26 while the sheet P passed was low. The reason for this was clarified as follows. Before a copy start command was received, rotation of the fixing and press rollers 25 and 26 was stopped, and the temperature of the press roller 26 decreased. With only "pre-rotation" after the copy start command was received, the temperature of the press roller 26 did not rise to a value sufficiently high for fixing.

In view of this, while detecting the temperature of the press roller 26, when the detected temperature was low, the rollers 25 and 26 were rotated at a high speed during "pre-rotation" after the copy start command. Then, the press roller 26 reached the predetermined temperature for image fixing, and fixing was performed well. In this manner, when the temperature of the press roller 26 was detected upon reception of the copy start command and the rotational speed was changed before the image reached the fixing apparatus 20, the press roller 26 could reach a temperature sufficiently high for fixing.

The third embodiment of the present invention will be described.

Figure 11:
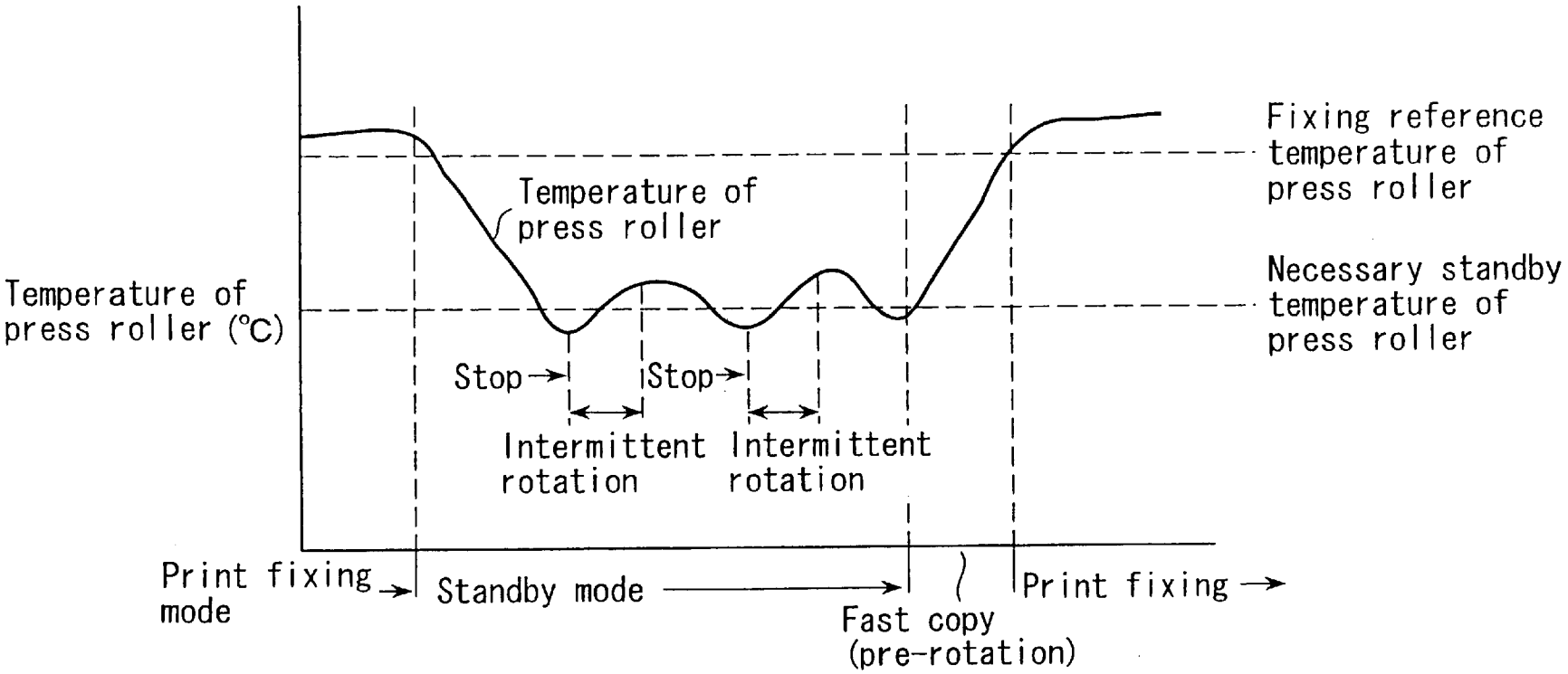
FIG. 11 is a graph showing temperature changes occurring when the heating and press rollers are intermittently rotated in the standby mode where image fixing is not performed.

The third embodiment refers to the standby mode wherein image fixing is not performed. In the standby mode, the temperature of a press roller 26 which is not in contact with an image to be fixed is detected. If the temperature is not a predetermined value, a fixing roller 25 is rotated intermittently to maintain the temperature of the press roller 26 at a certain constant level, as shown in FIG. 11.

More specifically, in the standby mode, when rotation of the rollers 25 and 26 is stopped, the temperature of the press roller 26 is detected. If the temperature is equal to the predetermined value or less, the rollers 25 and 26 are rotated. The press roller 26 is thus maintained at a temperature to which it can rise within a predetermined fast copy time.

"Predetermined temperature" refers to a temperature from which, when a copy start command is output, the press roller 26 can reach a temperature at which fixing can be performed with the predetermined fast copy time. When the fixing and press rollers 25 and 26 are rotated, heat of the fixing roller 25 is conducted to the press roller 26.

Conventionally, in the standby mode, the temperature of the press roller 26 was not detected, but only the temperature of the fixing roller 25 was detected and maintained at a constant value. After that, when image fixing was performed with a predetermined fast print time interval, defective fixing sometimes occurred in the first print obtained immediately after the standby mode.

In order to find the cause for this, the temperature of the press roller 26 was measured. During image fixing, the temperature of the press roller 26 was low, which was not sufficiently high for fixing. The reason for this was clarified as follows. In the standby mode, the temperature of the press roller 26 was excessively low. Accordingly, image fixing was subsequently performed before heat was not sufficiently absorbed in print "pre-rotation" by contact with the fixing roller 25.

The standby temperature of the press roller 26, which was necessary to reach the temperature necessary for fixing, within the predetermined fast print time, was obtained from the temperature necessary for fixing. The rollers 25 and 26 were intermittently rotated in the standby mode in order to maintain the standby temperature.

In this embodiment, this temperature was reached when the rollers were rotated through almost two to three revolutions in the standby mode. After that, this operation was performed when necessary while detecting the temperature of the press roller 26. In this manner, the image could be fixed well within the predetermined fast print time.

In the above embodiments, the photosensitive belt 2 and intermediate transfer drum 7 were used as the image carrier and intermediate transfer body, respectively. However, the present invention is not limited to this, and a photosensitive drum and an intermediate transfer belt may be used as the image carrier and intermediate transfer body, respectively. Alternatively, a photosensitive drum and intermediate transfer drum may be used as the image carrier and intermediate transfer body, or a photosensitive belt and intermediate transfer belt may be used as the image carrier and intermediate transfer body. Any combination will do as far as the toner images can be transferred in an overlaid manner and transferred onto a medium at once.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a fixing device, having a heating roller which rotates and a press roller which rotates in tight contact with the heating roller, and adopted to heat and press a medium with an unfixed image by passing the medium between the heating roller and the press roller, thereby fixing the unfixed image;

a detection device which detects temperatures of the heating and press rollers; and a control device which variably controls rotating states of the heating and press rollers based on the temperatures detected by said detection device, wherein when the heating roller reaches a reference temperature while the press roller is at a temperature not more than a predetermined temperature, said control device increases a rotational speed of the heating and press rollers.

2. A fixing apparatus comprising:

a fixing device, having a heating roller which rotates and a press roller which rotates in tight contact with the heating roller, and adopted to heat and press a medium with an unfixed image by passing the medium between the heating roller and the press roller, thereby fixing the unfixed image;

a detection device which detects temperatures of the heating and press rollers; and a control device which variably controls rotating states of the heating and press rollers based on the temperatures detected by said detection device, wherein when the press roller reaches a reference temperature while the heating roller is at a temperature not more than a predetermined temperature, said control device decreases a rotational speed of the heating and press rollers.

3. A fixing apparatus comprising:

a fixing device, having a heating roller which rotates and a press roller which rotates in tight contact with the heating roller, and adopted to heat and press a medium with an unfixed image by passing the medium between the heating roller and the press roller, thereby fixing the unfixed image;

a detection device which detects temperatures of the heating and press rollers; and a control device which variably controls rotating states of the heating and press rollers based on the temperatures detected by said detection device, wherein when a first image is to be fixed, if the temperature of the press roller detected by said detection device is not more than a predetermined temperature, said control device rotates the heating and press rollers at a high speed until the medium reaches a portion between the heating and press rollers.

* * * * *